US012448985B2

(12) United States Patent
Yabunouchi et al.

(10) Patent No.: US 12,448,985 B2
(45) Date of Patent: Oct. 21, 2025

(54) AIR BLOWER

(71) Applicant: Panasonic Intellectual Property Management Co., Ltd., Osaka (JP)

(72) Inventors: Nobuaki Yabunouchi, Kyoto (JP); Hayato Takahashi, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 18/710,534

(22) PCT Filed: Oct. 28, 2022

(86) PCT No.: PCT/JP2022/040403

§ 371 (c)(1),
(2) Date: May 15, 2024

(87) PCT Pub. No.: WO2023/095549

PCT Pub. Date: Jun. 1, 2023

(65) Prior Publication Data

US 2025/0035130 A1 Jan. 30, 2025

(30) Foreign Application Priority Data

Nov. 26, 2021 (JP) ..... 2021-192483

(51) Int. Cl.
*F04D 29/54* (2006.01)
*F04D 25/08* (2006.01)

(52) U.S. Cl.
CPC ..... *F04D 29/541* (2013.01); *F04D 25/088* (2013.01)

(58) Field of Classification Search
None
See application file for complete search history.

(56) References Cited

U.S. PATENT DOCUMENTS 4,568,521 A 2/1986 Spector
9,326,578 B2 * 5/2016 Yoshidome ..... A45D 20/10
(Continued)

FOREIGN PATENT DOCUMENTS

CH 588835 A5 6/1977
JP 2002-277010 A 9/2002
(Continued)

OTHER PUBLICATIONS

German Office Action dated Dec. 5, 2024 issued in the corresponding German Patent Application No. 112022004463.2, with English translation.

(Continued)

*Primary Examiner* — Juan G Flores
(74) *Attorney, Agent, or Firm* — Rimon P.C.

(57) ABSTRACT

An air blower includes a body, a fan, a rectifier unit, and an imparter. The body has a first inlet port, an outlet port, and a flow channel. The rectifier unit is disposed between a fan and the outlet port in a direction. The rectifier unit has a second inlet port. The rectifier unit divides an airflow into a first airflow and a second airflow. The first airflow has a flow velocity equal to or greater than a predetermined value. The second airflow has a flow velocity less than the predetermined value. The imparter imparts the functional component to the airflow within a range defined by projecting the first region in the direction and extending from the second inlet port through the outlet port.

8 Claims, 11 Drawing Sheets

(56) References Cited

U.S. PATENT DOCUMENTS

| | | | | |
|---|---|---|---|---|
| 2014/0208605 | A1* | 7/2014 | Yoshidome ..... | A45D 20/10 34/97 |
| 2015/0300385 | A1 | 10/2015 | Akagi et al. | |

FOREIGN PATENT DOCUMENTS

| | | | | |
|---|---|---|---|---|
| JP | 2003079421 | A | * | 3/2003 |
| JP | 2005-345027 | A | | 12/2005 |
| JP | 2015-167796 | A | | 9/2015 |
| JP | 5846617 | B2 | | 1/2016 |
| JP | 2019-211189 | A | | 12/2019 |
| WO | 2015/053053 | A1 | | 4/2015 |

OTHER PUBLICATIONS

International Search Report dated Jan. 10, 2023 issued in International Patent Application No. PCT/JP2022/040403, with English translation.

* cited by examiner

AIR BLOWER

This application is the U.S. National Phase under 35 U.S.C. § 371 of International Patent Application No. PCT/JP2022/040403, filed on Oct. 28, 2022, which in turn claims the benefit of Japanese Patent Application No. 2021-192483, filed on Nov. 26, 2021, the entire disclosures of which Applications are incorporated by reference herein.

TECHNICAL FIELD

The present disclosure generally relates to an air blower, and more particularly relates to an air blower including a fan.

BACKGROUND ART

Patent Literature 1 discloses a blower including a multi-blade fan and an ion generation source for generating ions. The blower lets ionizing air blow out from a nozzle.

CITATION LIST

Patent Literature

Patent Literature 1: WO 2015/053053 A1

SUMMARY OF INVENTION

A blower (air blower) for supplying air containing a functional component such as ions as disclosed in Patent Literature 1 is increasingly required to carry the functional component more efficiently to a target region.

An object of the present disclosure is to provide an air blower with the ability to carry a functional component more efficiently to a target region.

An air blower according to an aspect of the present disclosure includes a body, a fan, a rectifier unit, and an imparter. The body has a first inlet port for a gas, an outlet port for the gas, and a flow channel. The first inlet port is provided at a first end of the body. The outlet port is provided at a second end of the body. The flow channel connects the first inlet port to the outlet port. The flow channel has a circular cross section. The fan is disposed inside the body. The fan generates an airflow as a stream of the gas. The rectifier unit is disposed between the fan and the outlet port in a direction aligned with a direction pointing from the first inlet port toward the outlet port. The rectifier unit has a second inlet port for the gas. The imparter emits a functional component and thereby imparts the functional component to the airflow. The rectifier unit divides the airflow into a first airflow and a second airflow. A first region where the first airflow passes is located inside a second region where the second airflow passes when viewed in plan in the direction. The first airflow has a flow velocity equal to or greater than a predetermined value at a predetermined position. The second airflow has a flow velocity less than the predetermined value at the predetermined position. The imparter imparts the functional component to the airflow within a range defined by projecting, in the direction, the first region at the predetermined position and extending from the second inlet port through the outlet port.

DESCRIPTION OF EMBODIMENTS

Preferred embodiments of the present disclosure will now be described in detail with reference to the accompanying drawings. In the following description of embodiments, the same or like elements will be designated by the same reference sign and their description will be omitted herein to avoid redundancy. Note that the exemplary embodiments to be described below are only exemplary ones of various embodiments of the present disclosure and should not be construed as limiting. Rather, the exemplary embodiments may be readily modified in various manners depending on a design choice or any other factor without departing from the scope of the present disclosure. The drawings to be referred to in the following description of embodiments are all schematic representations. Thus, the ratio of the dimensions (including thicknesses) of respective constituent elements illustrated on the drawings does not always reflect their actual dimensional ratio.

First Embodiment

An air blower according to a first embodiment will now be described with reference to FIGS. 1-5B.

(1) Overview

Figure 1:
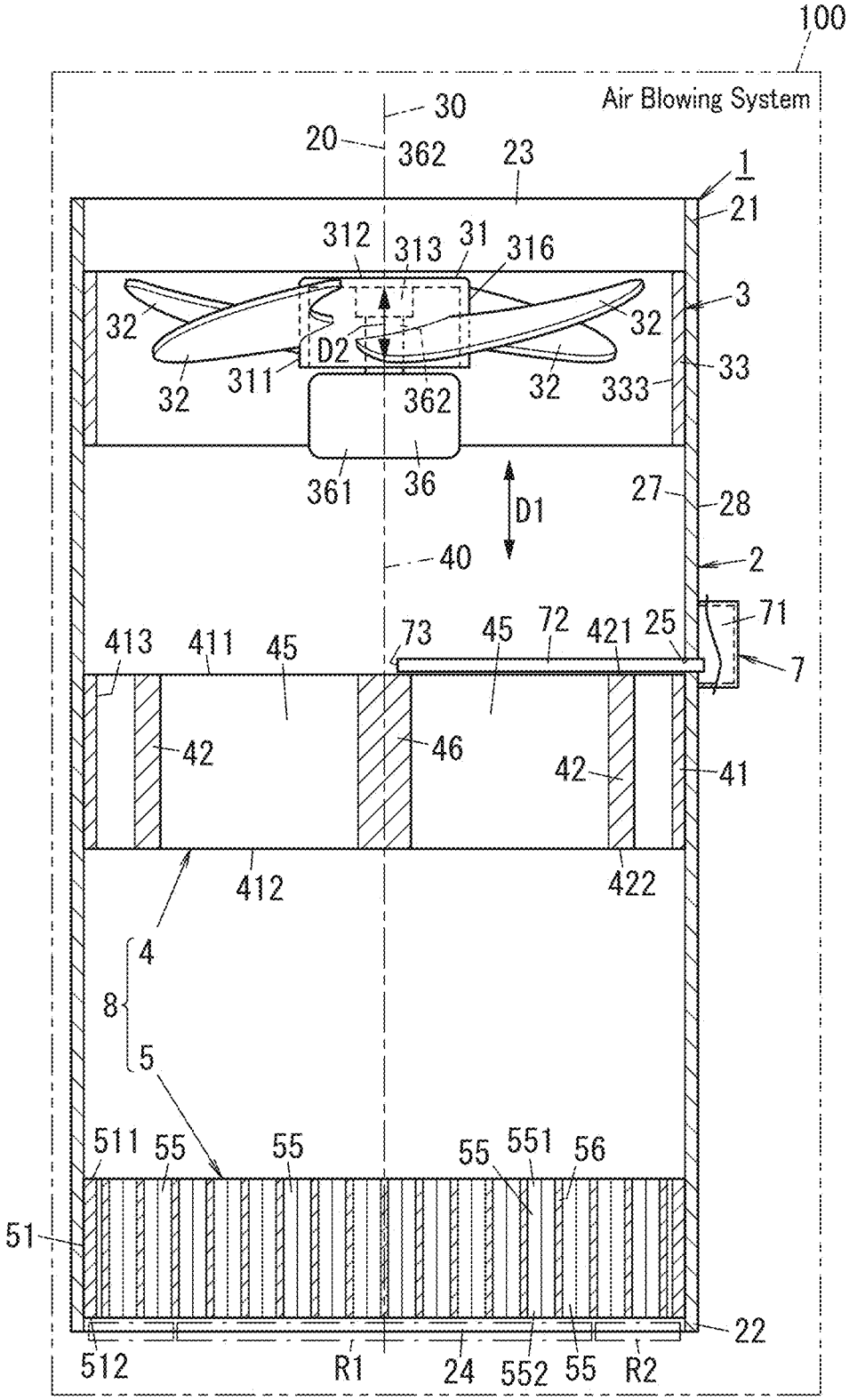
FIG. 1 illustrates a schematic configuration for an air blower according to a first embodiment.

The air blower 1 shown in FIG. 1 may be used, for example, in space zoning at a facility. As used herein, the "space zoning" refers to air zoning, which means creating an air environment in a particular area within a target space without putting any physical wall such as a building wall or a partition.

The facility may be an office building, for example. The target space may be, for example, a non-territorial office (which is called a "free-address office" in Japan) in the office building. However, the target space does not have to be a non-territorial office. Alternatively, the target space may also be a space such as an assembly room.

Examples of the facilities include not only office buildings but also hotels, hospitals, educational institutions, single-family dwelling houses, multi-family dwelling houses (including dwelling units and common areas), stores, commercial facilities, art museums, and museums. Optionally, the facility does not have to be a building alone but may also be a premise with the building. Examples of such facilities include factories, public parks, amusement facilities, theme parks, airports, railway stations, and domed ballparks.

The air blower 1 includes a body 2, a fan 3, an imparter 73, and a rectifier unit 8.

The body 2 has a first inlet port 23 for a gas at a first end 21 thereof, an outlet port 24 (first outlet port) for the gas at a second end 22 thereof, and a flow channel 26 that connects the first inlet port 23 to the outlet port 24. The flow channel 26 has a circular cross section.

The fan 3 is disposed inside the body 2 (i.e., in the flow channel 26). The fan 3 generates an airflow as a stream of the gas. The airflow (air) blows out from the outlet port 24 into a target space. The air blowing out into the target space is a jet and a directional airflow with a degree of straightness. The airflow is a stream of the air.

The rectifier unit 8 is interposed between the fan 3 and the outlet port 24 in a direction D1 aligned with a direction pointing from the first inlet port 23 toward the outlet port 24. The rectifier unit 8 has a second inlet port 411 for the gas.

The rectifier unit 8 divides the airflow into a first airflow and a second airflow. A first region R1 where the first airflow passes is located inside a second region R2 where the second airflow passes when viewed in plan in the direction D1. The first region R1 and the second region R2 have the shapes of concentric circles. The first airflow has a flow velocity equal to or greater than a predetermined value at a predetermined position. In the first embodiment, the "predetermined position" may be the outlet port 24, for example. The second airflow has a flow velocity less than the predetermined value at the predetermined position.

The imparter 73 emits a functional component and thereby imparts the functional component to the air. Examples of the functional components include a deodorization component, a fragrance component, a disinfection component, a sterilization component, a cosmetic component, and a pharmaceutical component.

The imparter 73 according to the first embodiment is arranged to be located around the center of the second inlet port 411 of the rectifier unit 8 when viewed in plan in the direction D1.

The imparter 73 according to the first embodiment imparts the functional component to the airflow within a range defined by projecting, in the direction D1, the first region R1 at the predetermined position (e.g., at the outlet port 24) and extending from the second inlet port 411 through the outlet port 24.

In the range from the second inlet port 411 of the rectifier unit 8 through the outlet port 24 of the body 2, the airflow is less turbulent than in the vicinity of the fan 3. The air blower 1 according to the first embodiments imparts the functional component to the airflow within the range extending from the second inlet port 411 through the outlet port 24 and defined by projecting the first region R1 in the direction D1. This allows the functional component to be imparted with good stability to the first airflow. The first airflow is less likely to diffuse. Thus, the air blower 1 according to the first embodiment may carry the functional component efficiently to the target region while reducing the diffusion of the functional component.

(2) Details

Figure 4:
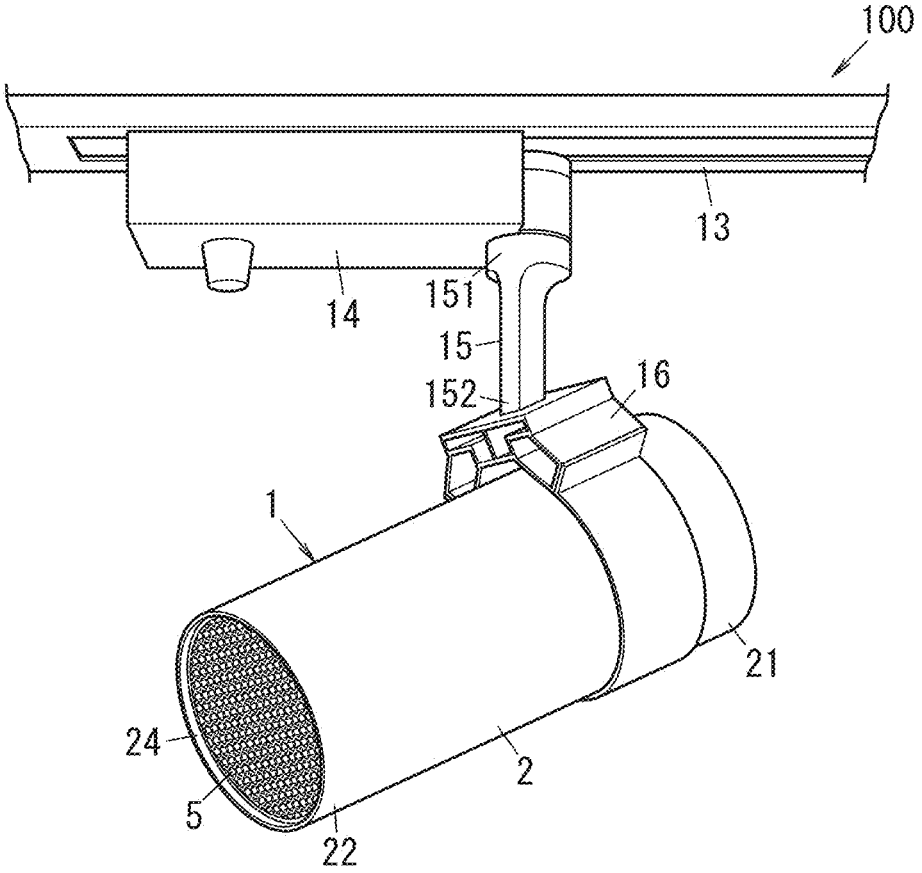
FIG. 4 is a perspective view of the air blower.

As shown in FIG. 4, an air blowing system 100 is installed onto, for example, a wiring duct 13 mounted on the ceiling. The air blowing system 100 includes the air blower 1, an installer 14, an arm 15, and a coupler 16. The installer 14 is slidably attached onto the wiring duct 13. The arm 15 has a first end 151 and a second end 152. In this arm 15, the first end 151 of the arm 15 is coupled to the installer 14. The coupler 16 couples the second end 152 of the arm 15 to the body 2 of the air blower 1. Attaching the installer 14 onto the wiring duct 13 electrically connects the air blowing system 100 to an AC power supply connected to the wiring duct 13. The air blowing system 100 further includes a power supply circuit, a driver circuit, and a controller. The power supply circuit converts an AC voltage supplied from the AC power supply into a predetermined DC voltage and outputs the DC voltage. The driver circuit receives the DC voltage supplied from the power supply circuit to drive a motor 36 of the fan 3. The power supply circuit, the driver circuit, and the controller are housed in the housing of the installer 14. The arm 15 and the coupler 16 each have a space into which an electric wire connected to the driver circuit may be passed.

The controller includes a computer system. The computer system may include a processor and a memory as principal hardware components thereof. The functions of the controller may be performed by making the processor execute a program stored in the memory of the computer system. The program may be stored in advance in the memory of the computer system. Alternatively, the program may also be downloaded through a telecommunications line or be distributed after having been recorded in some non-transitory storage medium such as a memory card, an optical disc, or a hard disk drive, any of which is readable for the computer system. The processor of the computer system may be made up of a single or a plurality of electronic circuits including a semiconductor integrated circuit (IC) or a large-scale integrated circuit (LSI). As used herein, the "integrated circuit" such as an IC or an LSI is called by a different name depending on the degree of integration thereof. Examples of the integrated circuits such as an IC or an LSI include integrated circuits called a "system LSI," a "very-large-scale integrated circuit (VLSI)," and an "ultra-large-scale integrated circuit (ULSI)." Optionally, a field-programmable gate array (FPGA) to be programmed after an LSI has been fabricated or a reconfigurable logic device allowing the connections or circuit sections inside of an LSI to be reconfigured may also be adopted as the processor. Those electronic circuits may be either integrated together on a single chip or distributed on multiple chips, whichever is appropriate. Those multiple chips may be aggregated together in a single device or distributed in multiple devices without limitation. As used herein, the "computer system" includes a microcontroller including one or more processors and one or more memories. Thus, the microcontroller may also be implemented as a single or a plurality of electronic circuits including a semiconductor integrated circuit or a large-scale integrated circuit.

(2.1) Air Blower

Figure 2:
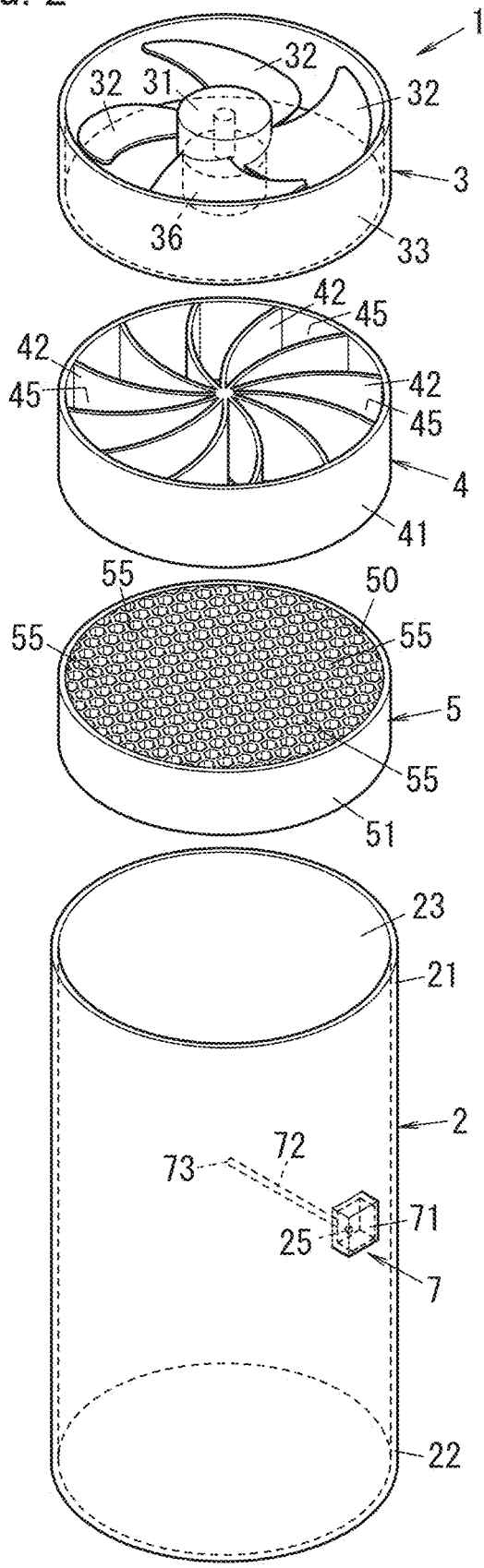
FIG. 2 is an exploded perspective view of the air blower.
Figure 3A:
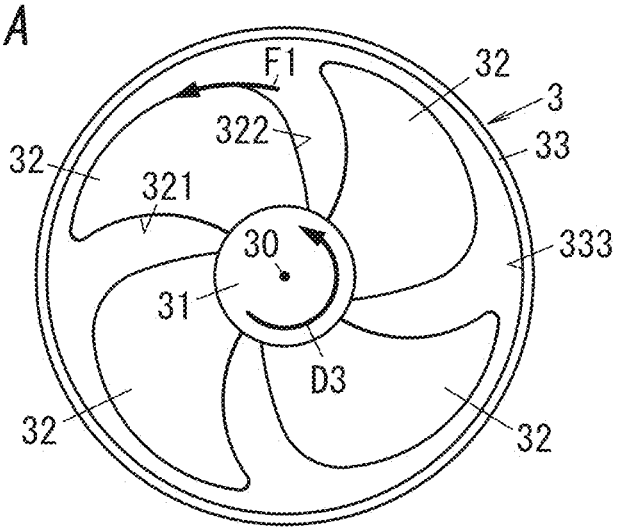
FIG. 3A is a plan view of a fan included in the air blower.
Figure 3B:
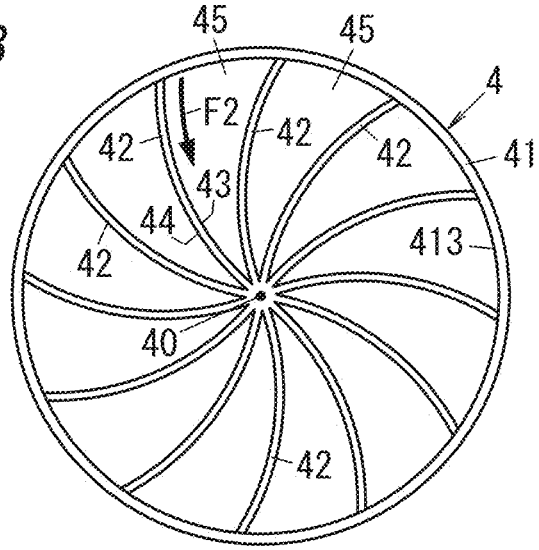
FIG. 3B is a plan view of a first rectifier included in the air blower.
Figure 3C:
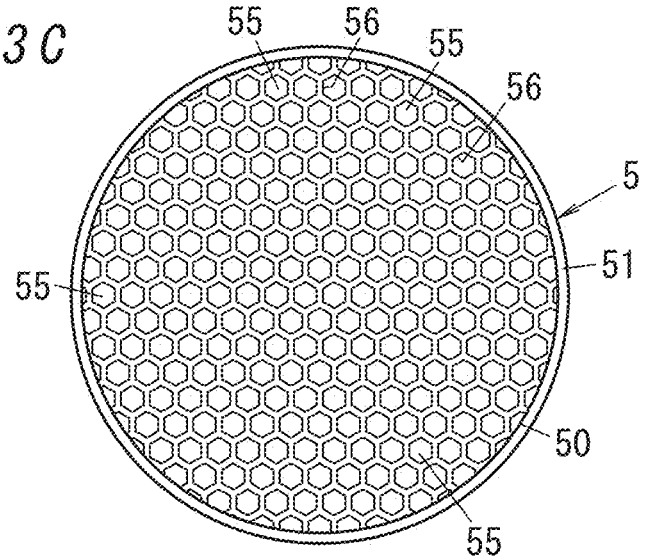
FIG. 3C is a plan view of a second rectifier included in the air blower.

As shown in FIGS. 1 and 2, the air blower 1 includes the body 2, the fan 3, a supplier 7, and the rectifier unit 8. The air blower 1 may control the velocity of the airflow blowing out from the outlet port 24 by adjusting the number of revolutions of the fan 3. The number of revolutions of the fan 3 varies as the magnitude of the voltage supplied from the driver circuit to the motor 36 changes.

The body 2 according to the first embodiment has a circular cylindrical shape. The body 2 has the first end 21 and the second end 22. The body 2 has the first inlet port 23 for a gas at the first end 21 and has the outlet port 24 for the gas at the second end 22. A material for the body 2 may be, but does not have to be, a metal or a resin, for example. The axial direction of the body 2 according to the first embodiment is aligned with the direction D1.

The body 2 has a communication hole 25. The communication hole 25 according to the first embodiment penetrates through the body 2 between the first end 21 of the body 2 and the second end 22 of the body 2 and extends in a direction intersecting with the axial direction (direction D1) of the body 2. The communication hole 25 is located, in the direction D1, between the fan 3 and the rectifier unit 8. Also, in the direction D1, the lower end of the communication hole 25 according to the first embodiment is generally level with the upper end of the rectifier unit 8. In other words, the communication hole 25 is located, in the direction D1, between the fan 3 and a first rectifier 4 (to be described later). In addition, in the direction D1, the lower end of the communication hole 25 is generally level with the upper end of the first rectifier 4.

The fan 3 lets the air flowing in the body 2 through the first inlet port 23 of the body 2 blow toward the outlet port 24 of the body 2. The fan 3 is an electric axial-flow fan rotatable around the center axis 30 of rotation of a rotator 31 included in the fan 3. The fan 3 may move the air flowing into a fan housing 33 while helically rotating the air around the rotator 31 to cause the air to flow to a downstream point. As used herein, the "downstream point" refers to a downstream point when viewed in the direction in which the air flows.

The fan 3 is disposed inside the body 2. The fan 3 is disposed closer to the first end 21 of the body 2 rather than to the second end 22 of the body 2 in the axial direction of the body 2. In the axial direction of the body 2, the distance from the fan 3 to the first inlet port 23 is shorter than the distance from the fan 3 to the outlet port 24. The fan 3 generates an airflow which is a stream of the gas.

The fan 3 includes the rotator (hub) 31, a plurality of (e.g., four) blades (rotary vanes) 32, the fan housing 33, the motor 36, a motor attachment, and a plurality of (e.g., three) beams. A material for the fan 3 may be, for example, a resin or a metal.

The rotator 31 is rotatable around the center axis 30 of rotation. When viewed in the axial direction D2 of the fan 3, the outer edge of the rotator 31 has a circular shape. In the first embodiment, the axial direction D2 of the fan 3 is aligned with the direction D1. The rotator 31 is disposed inside the body 2 to be coaxial with the body 2. As used herein, the expression "the rotator 31 is disposed inside the body 2 to be coaxial with the body 2" means that the rotator 31 is arranged such that the center axis 30 of rotation of the rotator 31 is aligned with the center axis 20 of the body 2. In the axial direction D2 of the fan 3, the rotator 31 is shorter in length than the body 2. The axial direction D2 of the fan 3 is a direction aligned with the center axis 30 of rotation. The rotator 31 has the shape of a bottomed cylinder having a circular cylindrical portion 311 and a bottom wall 312 and is arranged such that the bottom wall 312 faces the first inlet port 23 of the body 2. The rotator 31 includes a boss 313 protruding away from the first inlet port 23 from a central portion of the bottom wall 312.

The plurality of blades 32 are arranged between the rotator 31 and the fan housing 33 and rotate along with the rotator 31. The plurality of blades 32 are connected to the rotator 31 and protrude from an outer circumferential surface 316 of the rotator 31 toward an inner circumferential surface 27 of the body 2. When viewed in the axial direction D2 of the fan 3, the plurality of blades 32 radially protrude from the rotator 31. Each of the plurality of blades 32 is arranged such that a gap is left between the blade 32 and the inner circumferential surface 333 of the fan housing 33 when viewed in the axial direction D2 of the fan 3. In other words, the fan 3 has a gap between each of the plurality of blades 32 and the inner circumferential surface 333 of the fan housing 33. The plurality of blades 32 are arranged at regular intervals when viewed in the axial direction D2 of the fan 3. As used herein, the phrase "arranged at regular intervals" refers to not only a situation where the blades 32 are arranged at exactly the same intervals but also a situation where the difference between the intervals and a predefined interval falls within a predetermined tolerance range (e.g., within ±10% of the predefined interval). In each of the plurality of blades 32, a first end 321 (refer to FIG. 3A) thereof facing the first inlet port 23 is located forward of a second end 322 (refer to FIG. 3A) thereof facing the outlet port 24 in a rotational direction D3 (refer to FIG. 3A) of the rotator 31 of the fan 3.

The fan housing 33 houses the rotator 31 and the plurality of blades 32 to make the rotator 31 and the plurality of blades 32 rotatable. The fan housing 33 has a circular cylindrical shape. The outside diameter of the fan housing 33 is substantially equal to the inside diameter of the body 2 (i.e., the diameter of the inner circumferential surface 27). In the fan 3, the fan housing 33 may be fixed to the body 2, for example.

The motor 36 drives the rotator 31 in rotation. More specifically, the motor 36 rotates the rotator 31 around the center axis 30 of rotation of the rotator 31. The motor 36 may be, for example, a DC motor. The motor 36 is driven by the driver circuit described above. The motor 36 includes a motor body 361 and a rotary shaft 362 partially protruding from the motor body 361. In the motor 36, the rotary shaft 362 is coupled to the rotator 31. The rotary shaft 362 of the motor 36 is fixed to the boss 313 of the rotator 31.

To the motor attachment, the motor body 361 of the motor 36 is attached. When viewed in the axial direction D2 of the fan 3, the motor attachment may be located inside the outer edge of the rotator 31. However, this is only an example and should not be construed as limiting. Alternatively, when viewed in the axial direction D2 of the fan 3, the motor attachment may overlap in its entirety with the entire rotator 31, for example.

The plurality of (e.g., three) beams connect the motor attachment to the fan housing 33. The plurality of beams are arranged at regular intervals along the outer edge of the motor attachment.

The rectifier unit 8 is located, in the direction D1, between the fan 3 and the outlet port 24. As described above, the rectifier unit 8 divides the airflow into the first airflow and the second airflow. The rectifier unit 8 according to the first embodiment includes a first rectifier 4 and a second rectifier 5.

The first rectifier 4 is located, in the direction D1, between the fan 3 and the outlet port 24. The first rectifier 4 changes the flowing direction of the airflow F1 (refer to FIG. 3A) swirling downstream of the fan 3. More specifically, the first rectifier 4 turns the airflow F1 swirling downstream of the fan 3 into an airflow F2 (refer to FIG. 3B) flowing toward the center of the fan 3. In addition, the first rectifier 4 also forms a flow velocity distribution in which the velocity of an airflow in a third region is higher than the velocity of an airflow in a fourth region downstream of the first rectifier 4. As used herein, the "velocity" of the airflow refers to a velocity as measured in the direction D1. The third region herein refers to a region (inner region) located closer to the center axis 20 of the body 2 rather than to the inner circumferential surface 27 of the body 2. The fourth region herein refers to a region (outer region) located closer to the inner circumferential surface 27 of the body 2 rather than to the center axis 20 of the body 2.

The first rectifier 4 includes a cylindrical portion 41 having a circular cylindrical shape and a plurality of (e.g., twelve) fins 42.

The outside diameter of the cylindrical portion 41 is substantially equal to the inside diameter of the body 2. The inside diameter of the cylindrical portion 41 is substantially equal to the inside diameter of the fan housing 33. The cylindrical portion 41 has a second inlet port 411 for the gas. In other words, the first rectifier 4 has the second inlet port 411 for the gas. In addition, the cylindrical portion 41 also has a second outlet port 412 for the gas. The airflow flows into the cylindrical portion 41 through the second inlet port 411. Then, the airflow that flowed in through the second inlet port 411 travels inside the cylindrical portion 41 from the second inlet port 411 toward the second outlet port 412.

Each of the plurality of fins 42 has an arc shape when viewed in plan in the direction D1. The plurality of fins 42 protrude from the inner circumferential surface 413 of the cylindrical portion 41 toward the center axis 40 of the cylindrical portion 41 and are arranged side by side along the inner circumference of the cylindrical portion 41. Each of the plurality of fins 42 is coupled to the other fins 42 in a central portion 46 centered around the center axis 40. Each of the plurality of fins 42 has a first end 421, which is located closer to the first inlet port 23 (i.e., adjacent to the second inlet port 411) in the axial direction D1, and a second end 422, which is located closer to the outlet port 24 (i.e., adjacent to the second outlet port 412) in the axial direction D1.

The plurality of fins 42 are arranged between the inner circumferential surface 413 of the cylindrical portion 41 and the center axis of the cylindrical portion 41 to be parallel to the direction D1. In each of the plurality of fins 42, the first end 421 and the second end 422 thereof overlap with each other when viewed in the direction D1.

The respective ends, adjacent to the inner circumferential surface 413, of the plurality of fins 42 are arranged at regular intervals along the circumference of the cylindrical portion 41. As used herein, the phrase "arranged at regular intervals" refers to not only a situation where the respective ends of the fins 42 are arranged at exactly the same intervals but also a situation where the difference between the intervals and a predefined interval falls within a predetermined tolerance range (e.g., within ±10% of the predefined interval). The first rectifier 4 has a plurality of (e.g., twelve) flow channels 45, each of which is surrounded with two adjacent fins 42 out of the plurality of fins 42 and the inner circumferential surface 413 of the cylindrical portion 41. When viewed in the direction D1, the width, measured along the circumference of the cylindrical portion 41, of each flow channel 45 narrows from the inner circumferential surface 413 of the cylindrical portion 41 toward the center axis 40 of the cylindrical portion 41. Note that the plurality of flow channels 45 form respective parts of the flow channel 26.

When measured in the direction D1, the length of each of the plurality of fins 42 may be equal to the length of the cylindrical portion 41. However, the length of each of the plurality of fins 42 does not have to be equal to the length of the cylindrical portion 41 but may be longer or shorter than the length of the cylindrical portion 41, whichever is appropriate.

Each of the plurality of fins 42 has a first surface 43 intersecting with the circumference of the body 2 and a second surface 44 intersecting with the circumference of the body 2 and located opposite from the first surface 43. The first surface 43 is a surface located backward of the second surface 44 in the rotational direction D3 of the rotator 31 (refer to FIG. 3A). The second surface 44 is a surface located forward of the first surface 43 in the rotational direction D3 of the rotator 31. The first surface 43 is a curved concave surface. The second surface 44 is a curved convex surface.

A material for the first rectifier 4 may be, but does not have to be, a metal, and may also be a resin.

The second rectifier 5 is located, in the direction D1, between the first rectifier 4 and the outlet port 24 of the body 2. The second rectifier 5 unifies the flowing directions of the airflows into a direction pointing from the first inlet port 23 toward the outlet port 24. The second rectifier 5 adjusts, downstream of the first rectifier 4, the flow velocity distribution of the airflow coming from the first rectifier 4.

The second rectifier 5 has a plurality of flow channels 55 aligned with the direction D1. Each of the plurality of flow channels 55 has an inlet 551 facing the first rectifier 4 and an outlet 552 facing the outlet port 24 of the body 2. The inlet 551 of each of the plurality of flow channels 55 is a portion, through which the airflow that has flowed out of the first rectifier 4 flows into the flow channel 55. The outlet 552 of each of the plurality of flow channels 55 is a portion, through which the airflow that has flowed into the flow channel 55 flows out of the flow channel 55. In each of the plurality of flow channels 55, the inlet 551 and the outlet 552 have the same shape. In each of the plurality of flow channels 55, the inlet 551 and the outlet 552 have the same size. The plurality of flow channels 55 form respective parts of the flow channel 26.

The second rectifier 5 includes a rectifying grid 50 and a cylindrical portion 51 surrounding the rectifying grid 50 and having a circular cylindrical shape. The rectifying grid 50 includes a plurality of partitions 56 partitioning, from each other, any two adjacent flow channels 55 out of the plurality of flow channels 55. The plurality of partitions 56 are arranged in the direction D1. The rectifying grid 50 has the shape of a honeycomb grid. In this embodiment, when viewed in plan in the direction D1, the inlet 551 and outlet 552 of each of the plurality of flow channels 55 each have a regular hexagonal shape. In other words, each of the plurality of flow channels 55 has a hexagonal prism shape.

The outside diameter of the cylindrical portion 51 is substantially equal to the inside diameter of the body 2. The second rectifier 5 is disposed in the body 2 such that the center axis of the cylindrical portion 51 is aligned with the center axis 20 of the body 2.

A material for the second rectifier 5 may be, but does not have to be, a resin, and may also be a metal, for example.

The supplier 7 may supply a functional component, which will eventually be allowed to diffuse into the air in the surrounding environment, to the airflow that is going to blow out from the outlet port 24. More specifically, the supplier 7 includes a generator 71, a coupler 72, and an imparter 73.

The generator 71 generates the functional component. The generator 71 generates, for example, mist containing the functional component. The generator 71 is configured to supply the functional component from a functional material containing the functional component. Examples of such a functional material containing the functional component include a solution containing the functional component. The generator 71 according to the first embodiment is provided outside the body 2. That is to say, the generator 71 according to the first embodiment is provided outside the flow channel 26. In the air blower 1 according to the first embodiment, the generator 71 is located outside the flow channel 26, thus reducing the chances of the generator 71 impeding the stream of the airflow.

The generator 71 includes: an atomizer for atomizing, for example, a solution containing the functional component: and an energy supply device for giving energy to the solution to allow the atomizer to atomize the solution. The energy supply device may be, but does not have to be, an ultrasonic vibrator, for example, and may also be a surface acoustic wave (SAW) device, for example. The generator 71 according to the first embodiment is driven by a controller.

The coupler 72 connects the generator 71 to the imparter 73. The coupler 72 according to the first embodiment has a tubular shape. The functional component generated by the generator 71 passes inside the coupler 72 to reach the imparter 73.

The coupler 72 penetrates through the communication hole 25 to protrude, along the radius of the body 2, from the inner circumferential surface 27 of the body 2 toward the center axis 20 of the body 2. The coupler 72 connects the generator 71 located outside the body 2 to the imparter 73 located inside the body 2.

The imparter 73 is located, in the direction D1, between the fan 3 and the outlet port 24. More specifically, the lower end of the imparter 73 is generally level, in the direction D1, with the upper end of the first rectifier 4. At the second inlet port 411 of the first rectifier 4, the airflow is less turbulent than in the vicinity of the fan 3. In addition, when viewed in plan in the direction D1, the imparter 73 is arranged to overlap with the central portion 46 of the first rectifier 4 (i.e., the central portion of the second inlet port 411). The central portion 46 of the first rectifier 4 falls within a range defined by projecting, in the direction D1, the first region R1 at the outlet port 24 (i.e., at a predetermined position).

The imparter 73 imparts, to the airflow, the mist containing the functional component which has been generated by the generator 71. The imparter 73 according to the first embodiment imparts the mist containing the functional component to the airflow at the second inlet port 411 of the first rectifier 4. The central portion of the second inlet port 411 makes the airflow less turbulent and falls within the range defined by projecting, in the axial direction D2, the first region R1. This allows the imparter 73 to impart the functional component to the first airflow with good stability.

The functional component may be charged water particles including OH radicals. In that case, the supplier 7 may be, for example, an electrostatic atomizer for generating charged water particles including OH radicals. The charged water particles are fine particle ions of a nanometer scale. The electrostatic atomizer may generate fine particle ions having a particle size falling within the range from 5 nm to 20 nm by applying a high voltage to water in the air, for example. In the charged water particles, the OH radicals readily act on various substances.

(3) Operation of Air Blower

In the air blower 1, the rotator 31 and the plurality of blades 32 of the fan 3 turn in the predetermined rotational direction D3 (refer to FIG. 3A), thereby causing the air to rush into the fan 3 through the first inlet port 23 of the body 2. As a result, an airflow F1 (refer to FIG. 3A) swirling along the inner circumferential surface 27 of the body 2 is generated inside the body 2 downstream of the fan 3 inside the body 2. The swirling airflow F1 is a spirally turning, three-dimensional airflow.

In the air blower 1, the airflow F1 generated downstream of the fan 3 which is swirling, around the inner circumferential surface 27 of the body 2, along the inner circumferential surface 27 has its flowing direction changed, by the first rectifier 4, to a direction pointing toward the center axis 40 of the first rectifier 4. More specifically, in the first rectifier 4, the airflow F1 (refer to FIG. 3A) swirling along the inner circumferential surface 27 of the body 2 collides against the fins 42, thereby turning the airflow F1 into an airflow F2 (refer to FIG. 3B) flowing toward the center axis 40 of the first rectifier 4. In other words, the first rectifier 4 collects the airflow F1 generated by the fan 3 which is swirling along the inner circumferential surface 27 of the body 2 toward the center axis 40 of the first rectifier 4 and thus forms, downstream of the first rectifier 4, a flow velocity distribution in which the velocity of an airflow in the third region is higher than the velocity of an airflow in the fourth region. In sum, the air blower 1 may have the first rectifier 4 form a velocity distribution in which the velocity of the airflow is relatively high inside and relatively low outside.

In this case, the velocity of the airflow is a velocity measured in the direction D1. The third region herein refers to a region (inner region) located closer to the center axis 20 of the body 2 rather than to the inner circumferential surface 27 of the body 2 between the center axis 20 of the body 2 and the inner circumferential surface 27 of the body 2. The fourth region herein refers to a region (outer region) located closer to the inner circumferential surface 27 of the body 2 rather than to the center axis 20 of the body 2 between the center axis 20 of the body 2 and the inner circumferential surface 27 of the body 2.

In the air blower 1, the second rectifier 5 provided downstream of the first rectifier 4 changes the flowing direction of the airflow coming from the first rectifier 4 into the direction aligned with the direction D1.

In the air blower 1, an airflow rectified by the second rectifier 5 flows out from the outlet port 24 of the body 2.

In the air blower 1, when the fan is driven, an airflow flowing downstream of the fan 3 is rectified by the first rectifier 4 and the second rectifier 5 to blow out from the outlet port 24 of the body 2.

Figure 5A:
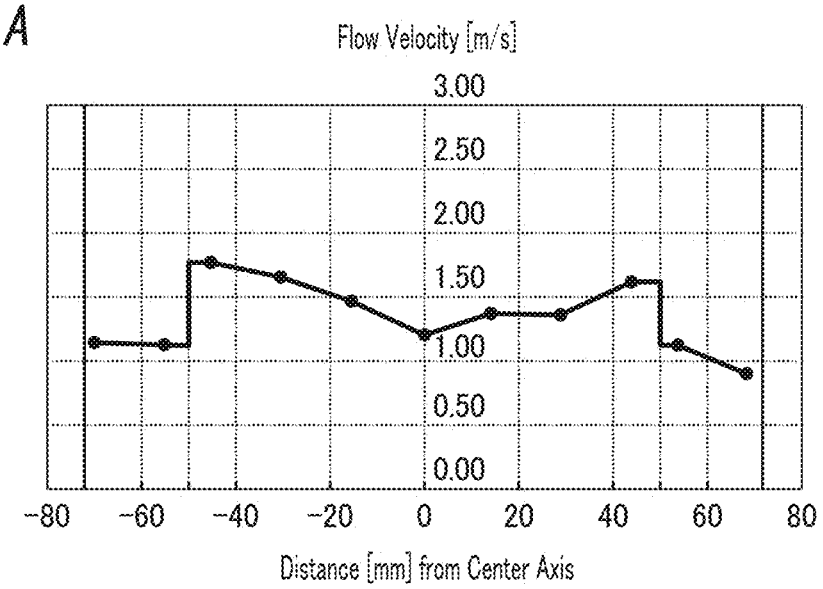
FIG. 5A shows the distribution of flow velocities in the air blower.

FIG. 5A shows a flow velocity distribution in the vicinity of the outlet port 24 of the body 2 of the air blower 1. FIG. 5A shows the flow velocity distribution in the air blower 1 of the air blowing system 100 according to the first embodiment in a situation where the air volume of the fan 3 is set at 70 $m^3/h$ and the structural parameters are set as follows. Meanwhile, FIG. 5B shows a flow velocity distribution in an air blower according to a comparative example including neither the first rectifier 4 nor the second rectifier 5.

Structure Parameters

- Inside diameter of the body 2: 144 mm;
- Number of fins 42 of the first rectifier 4: 12;
- Length of each fin 42 in the direction D1: 50 mm;
- Inlet 551 of each flow channel 55 in the second rectifier 5: regular hexagon having a distance of 8 mm between opposite sides;
- Outlet 552 of each flow channel 55 in the second rectifier 5: regular hexagon having a distance of 8 mm between opposite sides; and
- Length of each flow channel 55 in the second rectifier 5: 30 mm.

Figure 5B:
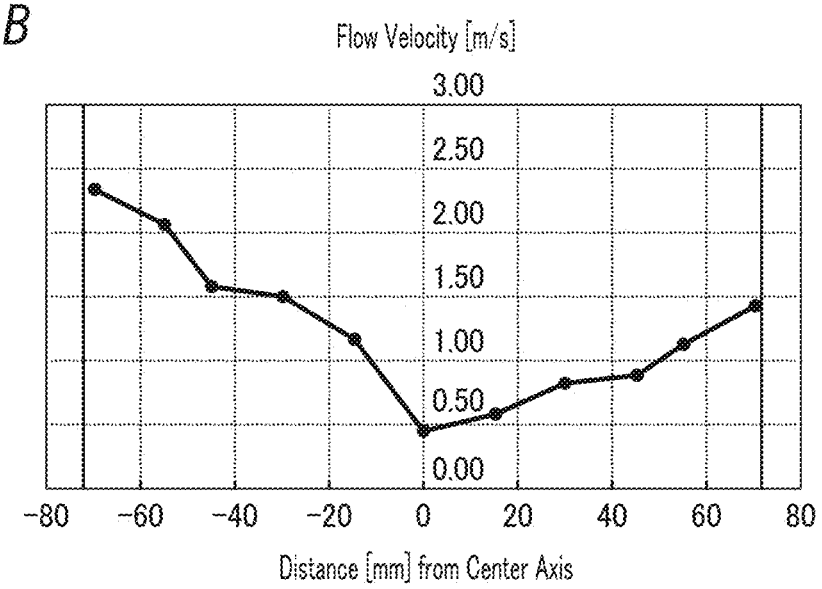
FIG. 5B shows the distribution of flow velocities in an air blower according to a comparative example.

Each of FIGS. 5A and 5B shows the flow velocity distribution at a cross section including the center axis 20 of the body 2. In each of FIGS. 5A and 5B, the abscissa indicates the distance as measured from the center axis 20 of the body 2, and the ordinate indicates the flow velocity. The abscissa is "positive" on the right of the center axis 20 and "negative (– sign)" on the left of the center axis. These "positive" and "negative (−)" signs are given to distinguish a distance to an arbitrary location on the right of the center axis 20 and a distance to an arbitrary location on the left of the center axis 20 from each other.

In the air blower according to the comparative example, the flow velocity increases as the distance from the center of the outlet port 24 increases as shown in FIG. 5B. In contrast, the air blower 1 of the air blowing system 100 according to the first embodiment may provide a flow velocity distribution in which the flow velocity in the inner region of the outlet port 24 is higher than the flow velocity in the outer region of the outlet port 24 as shown in FIG. 5A. The air blower 1 may blow out double jet streams, namely, a first jet stream (first airflow) blowing out from the inner region of the outlet port 24 and a second jet stream (second airflow) blowing out from the outer region of the outlet port 24.

As described above, the first airflow has a flow velocity equal to or greater than a predetermined value in the vicinity of the outlet port 24. On the other hand, the second airflow has a flow velocity less than the predetermined value in the vicinity of the outlet port 24. The predetermined value may be 1.2 m/s, for example. In the flow velocity distribution shown in FIG. 5A, the flow velocity is equal to or greater than 1.2 m/s in a region, of which the distance from the center axis 20 of the body 2 is within ±50 mm. Thus, the first region R1 through which the first airflow passes has the shape of a circle, of which the center is defined by the center axis 20 of the body 2 and the radius is 50 mm.

(4) Variations

Note that the first embodiment described above is only an exemplary one of various embodiments of the present disclosure and should not be construed as limiting. Rather, the first embodiment may be readily modified in various manners depending on a design choice or any other factor without departing from the scope of the present disclosure.

Next, variations of the first embodiment will be enumerated one after another. Note that the variations to be described below may be adopted in combination as appropriate.

The supplier 7 may be configured to carry the mist containing the functional component into the body 2 by having the mist containing the functional component sucked into the airflow inside the body 2. Alternatively, the supplier 7 may include a fan for supplying the mist containing the functional component into the body 2.

In the supplier 7, the generator 71 may include a plurality of atomizers for atomizing solutions containing mutually different functional components. In that case, the air blowing system 100 may have the generator 71 controlled by the controller to change the functional component supplied to the airflow (first airflow) to blow out from the outlet port 24.

For example, in the plurality of fins 42, not all of their first ends 421 and all of their second ends 422 have to overlap with each other, but at least some of their first ends 421 and at least some of their second ends 422 may overlap with each other when viewed in the direction D1. Alternatively, each of the plurality of fins 42 may also be configured such that the first end 421 and the second end 422 thereof do not overlap with each other when viewed in the direction D1.

Also, in the second rectifier 5, the rectifying grid 50 does not have to have the honeycomb grid shape but may also have, for example, the shape of a square grid or a triangular grid.

Furthermore, the second rectifier 5 does not have to be the rectifying grid 50 but may also be a rectifying grid including a bundle of a plurality of (e.g., 19) fine tubes or may also be a porous plate (e.g., a punched metal sheet). Each of the plurality of fine tubes includes the flow channel 55. The porous plate has a plurality of through holes serving as the plurality of flow channels 55.

Optionally, in the air blower 1, the body 2 may also serve as the fan housing 33 of the fan 3. Furthermore, in the air blower 1, the body 2 may also serve as the cylindrical portion 41 of the first rectifier 4. Furthermore, in the air blower 1, the body 2 may also serve as the cylindrical portion 51 of the second rectifier 5.

The body 2 has only to have the first inlet port 23 at the first end 21 thereof and the outlet port 24 at the second end 22 thereof and does not have to have the circular cylindrical shape.

Alternatively, the air blower 1 may be embedded in a ceiling material such that the outlet port 24 of the body 2 faces the target space. Alternatively, the body 2 may also be mounted on either a wall or a pedestal.

Furthermore, the air blower 1 may also be configured to allow the air coming from an air conditioner unit provided upstream of the air blower 1 to flow into the air blower 1 through the first inlet port 23 of the body 2. The air conditioner unit may be, but does not have to be, a blower. Alternatively, the air conditioner unit may also be, for example, a ventilator, an air conditioner, an air supplying cabinet fan, or an air conditioning system including a blower and a heat exchanger.

Alternatively, the imparter 73 may also be arranged not to overlap with the central portion 46 of the first rectifier 4 when viewed in plan in the direction D1. The imparter 73 only needs to be disposed to fall within a range defined by projecting, in the direction D1, the first region R1 at a predetermined position (e.g., at the outlet port 24).

The coupler 72 may have an effective component passage that runs from the generator 71 through the communication hole 25 outside the body 2.

The lower end of the communication hole 25 does not have to be generally level with the upper end of the first rectifier 4. Optionally, when viewed in plan along the radius of the body 2, the coupler 72 may be tilted with respect to the radius of the body 2. Furthermore, the coupler 72 does not have to be linear but may also be curvilinear. That is to say, as long as the imparter 73 is configured to be able to impart the functional component to the airflow at the second inlet port 411 of the first rectifier 4, the position of the communication hole 25 and the protruding direction and shape of the coupler 72 may be changed as appropriate.

Second Embodiment

An air blower 1 according to a second embodiment imparts a functional component to the airflow at an outlet 614 of a third rectifier 6 (to be described later) by having the imparter 73 emit the functional component toward an inlet 613 of the third rectifier 6, which is a difference from the air blower 1 according to the first embodiment.

The air blower 1 according to the second embodiment will now be described with reference to FIG. 6.

Figure 6:
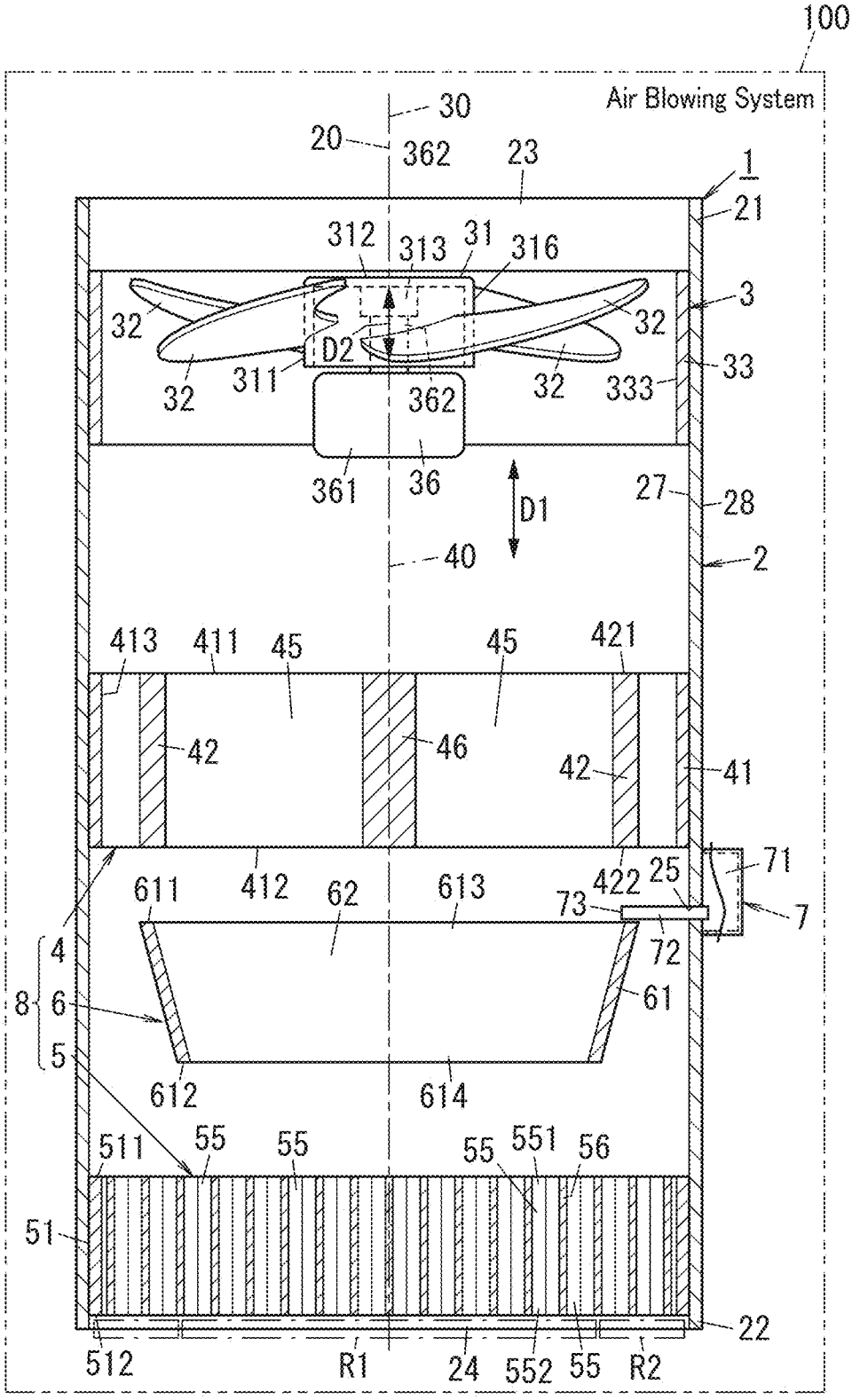
FIG. 6 illustrates a schematic configuration for an air blower according to a second embodiment.

As shown in FIG. 6, the rectifier unit 8 of the air blower 1 according to the second embodiment includes not only the first rectifier 4 and the second rectifier 5 but also the third rectifier 6 as well.

The third rectifier 6 is located, in the direction D1, between the first rectifier 4 and the second rectifier 5. The third rectifier 6 includes an inner cylindrical member 61, which has a flow channel 62 with a circular cross section. Note that the flow channel 62 forms part of the flow channel 26.

The inner cylindrical member 61 has a first end 611 and a second end 612. The inner cylindrical member 61 has a circular inlet 613 at the first end 611 thereof and a circular outlet 614 at the second end 612 thereof. The inlet 613 is an inlet port through which the gas flows into the inner cylindrical member 61. The outlet 614 is an outlet port through which the gas flows out of the inner cylindrical member 61. The outlet 614 has a smaller diameter than the inlet 613. The outside diameter of the inner cylindrical member 61 is smaller than the inside diameter of the body 2. Thus, the inner cylindrical member 61 has a smaller flow channel cross-sectional area than the body 2. The inside diameter and outside diameter of the inner cylindrical member 61 decrease in the direction D1 from the inlet 613 toward the outlet 614. The inner cylindrical member 61 is disposed inside the body 2 to be coaxial with the body 2 such that the inlet 613 is arranged to face the first rectifier 4 and the outlet 614 is arranged to face the second rectifier 5 in the direction D1. A material for the inner cylindrical member 61 may be, but does not have to be, a metal or a resin. Note that the third rectifier 6 includes a plurality of attachments for attaching the inner cylindrical member 61 to the body 2.

The third rectifier 6 functions as a diaphragm which rectifies the airflow to further increase the velocity of the airflow in the third region, and to further decrease the velocity of the airflow in the fourth region, downstream of the first rectifier 4. The air blower 1 including the third rectifier 6 may increase the flow velocity in the inner region of the outlet port 24 and decrease the flow velocity in the outer region of the outlet port 24, thus widening the difference in flow velocity between the inner and outer regions of the outlet port 24 and increasing the degree of directivity of the airflow blowing out from the outlet port 24, compared to the air blower 1 including no third rectifier 6.

The communication hole 25 according to the second embodiment is located, in the direction D1, between the first rectifier 4 and the third rectifier 6. In addition, in the direction D1, the lower end of the communication hole 25 according to the first embodiment is generally level with the first end 611 of the third rectifier 6.

The coupler 72 according to the second embodiment penetrates through the communication hole 25 to protrude, along the radius of the body 2, from the inner circumferential surface 27 of the body 2 toward the inlet 613 of the inner cylindrical member 61.

The imparter 73 is located, in the direction D1, between the first rectifier 4 and the third rectifier 6. More specifically, in the direction D1, the lower end of the imparter 73 is generally level with the first end 611 of the inner cylindrical member 61. In addition, when viewed in plan in the direction D1, the imparter 73 is arranged to overlap with the first end 611 of the inner cylindrical member 61.

The imparter 73 according to the second embodiment emits the functional component toward the inlet 613 (of the inner cylindrical member 61) of the third rectifier 6 and thereby imparts the functional component to the airflow at the outlet 614 (of the inner cylindrical member 61) of the third rectifier 6. In other words, the part of the inner cylindrical member 61 which runs from the inlet 613 through the outlet 614 thereof serves as a passage portion for carrying the functional component. In addition, the outlet 614 of the inner cylindrical member 61 serves as the imparter (emitter) for imparting the functional component to the airflow. Thus, it can be said that the third rectifier 6 serves as a part of the supplier 7 and the third rectifier 6 (of the rectifier unit 8) and the supplier 7 are formed integrally with each other.

The position of the outlet 614 of the inner cylindrical member 61 falls within the range defined by projecting, in the direction D1, the first region R1 at the outlet port 24 (at the predetermined position). Having the imparter 73 impart the functional component to the airflow at the outlet 614 having the smaller diameter than the inlet 613 allows the functional component to remain in the first airflow more efficiently. In addition, the imparter 73 is arranged to overlap with the first end 611 of the inner cylindrical member 61 when viewed in plan in the direction D1. This reduces the chances of the imparter 73 and the coupler 72 impeding the airflow compared to a situation where the imparter 73 is disposed around the center axis 40.

Alternatively, the imparter 73 may also be located inside the inner circumferential surface of the first end 611 of the inner cylindrical member 61 when viewed in plan in the direction D1.

Optionally, the inner cylindrical member 61 of the imparter 73 may include a diameter narrowing (i.e., tapering) portion, of which the inside and outside diameters change gradually, and a circular cylindrical portion, of which the inside and outside diameters are constant.

Note that the various configurations (including variations) described for the second embodiment may be adopted as appropriate in combination with the various configurations (including variations) already described for the first embodiment.

Third Embodiment

In an air blower 1 according to a third embodiment, the imparter 73 imparts the functional component to the airflow at a point between a second rectifier 5 (to be described later) and the outlet port 24, which is a difference from the air blower 1 according to the first embodiment.

The air blower 1 according to the third embodiment will now be described with reference to FIG. 7.

Figure 7:
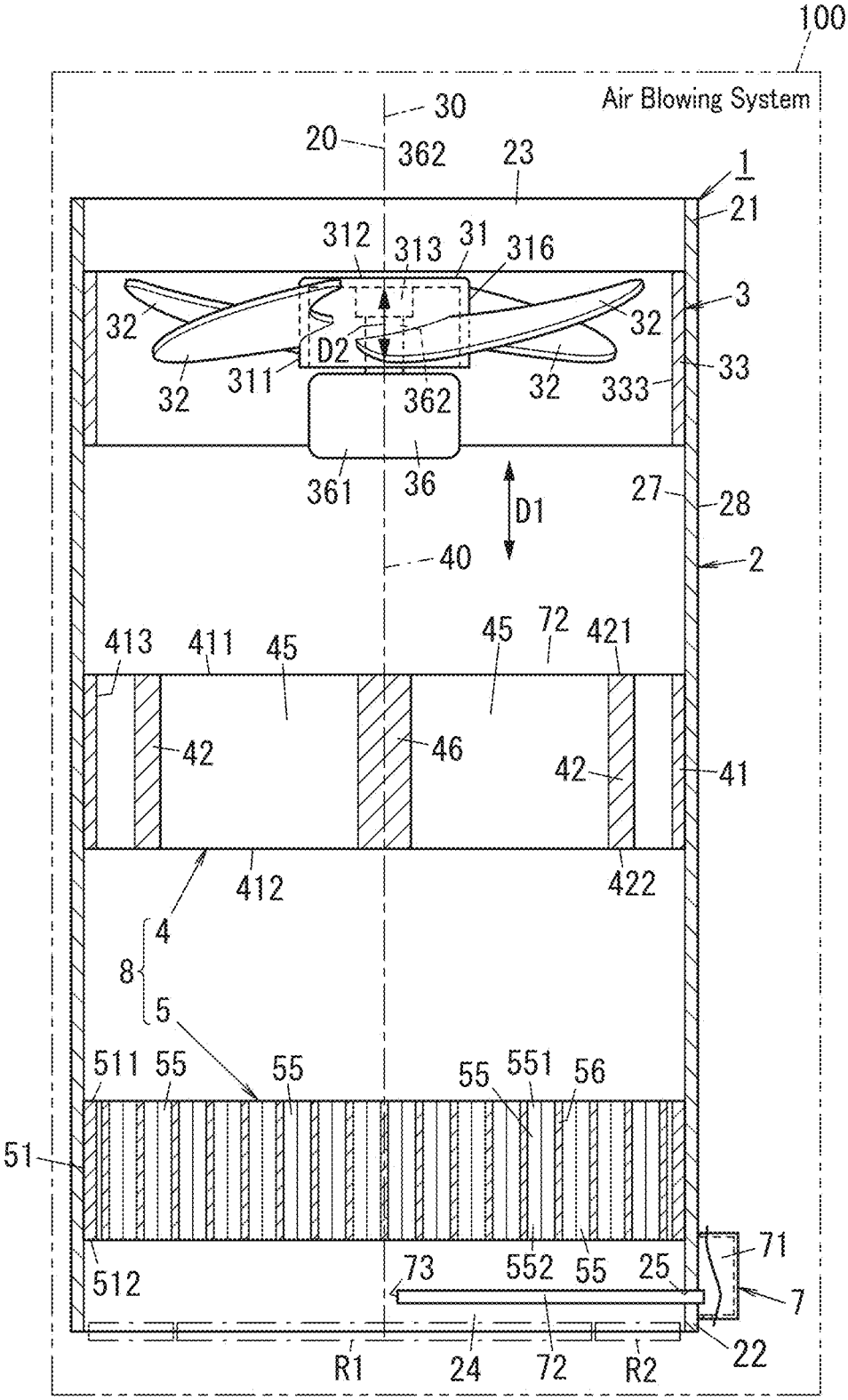
FIG. 7 illustrates a schematic configuration for an air blower according to a third embodiment.

As shown in FIG. 7, the rectifier unit 8 of the air blower 1 according to the third embodiment includes the first rectifier 4 and the second rectifier 5.

The communication hole 25 according to the third embodiment is located, in the direction D1, between the second rectifier 5 and the outlet port 24.

The coupler 72 penetrates through the communication hole 25 to protrude, along the radius of the body 2, from the inner circumferential surface 27 of the body 2 toward the center axis 20 of the body 2.

The imparter 73 is located, in the direction D1, between the first rectifier 4 and the outlet port 24. In addition, when viewed in plan in the direction D1, the imparter 73 is arranged to overlap with the central portion 46 of the first rectifier 4. The central portion 46 of the first rectifier 4 falls within the range defined by projecting, in the direction D1, the first region R1 at the outlet port 24 (at the predetermined position).

The imparter 73 imparts, to the airflow, the mist containing the functional component which has been generated by the generator 71. The imparter 73 according to the third embodiment imparts the mist containing the functional component to the airflow at a point between the second rectifier 5 and the outlet port 24. More specifically, the imparter 73 imparts the mist containing the functional component to the airflow at a point in the direction D1 between the outlet 552 of the second rectifier 5 and the second end 22 of the body 2. In the air blower 1 according to the third embodiment, the imparter 73 imparts the functional component to the airflow downward of the second rectifier 5 (of the rectifier unit 8), thus reducing the chances of the functional component imparted to the airflow adhering to the rectifier unit 8 and/or the body 2.

Note that the various configurations described for the third embodiment may be adopted as appropriate in combination with the various configurations (including variations) already described for the first and second embodiments.

Fourth Embodiment

In an air blower 1 according to a fourth embodiment, the imparter 73 is formed integrally with the rectifier unit 8, which is a difference from the air blower 1 according to the first embodiment described above.

The air blower 1 according to the fourth embodiment will now be described with reference to FIGS. 8 and 9.

Figure 8:
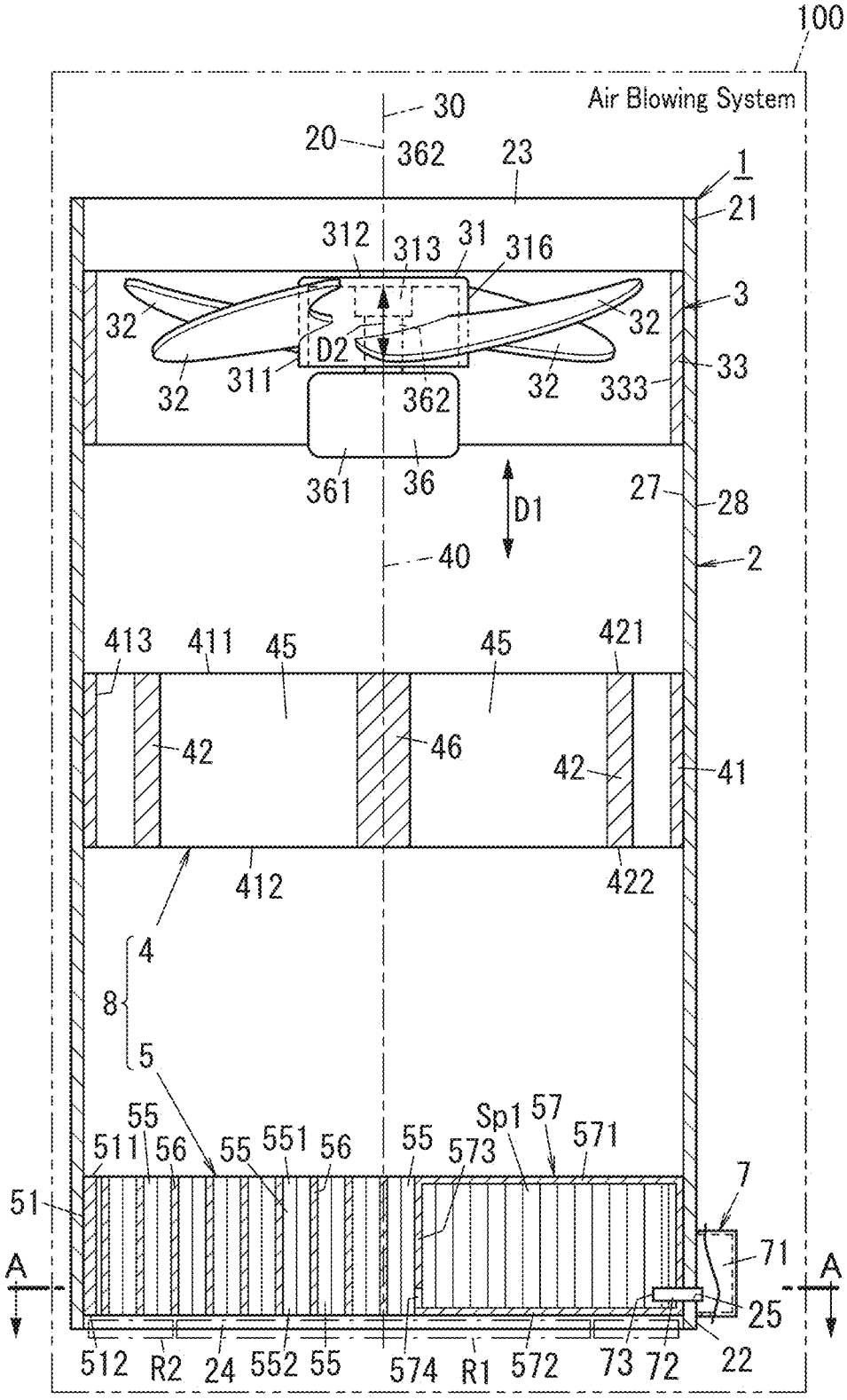
FIG. 8 illustrates a schematic configuration for an air blower according to a fourth embodiment.
Figure 9:
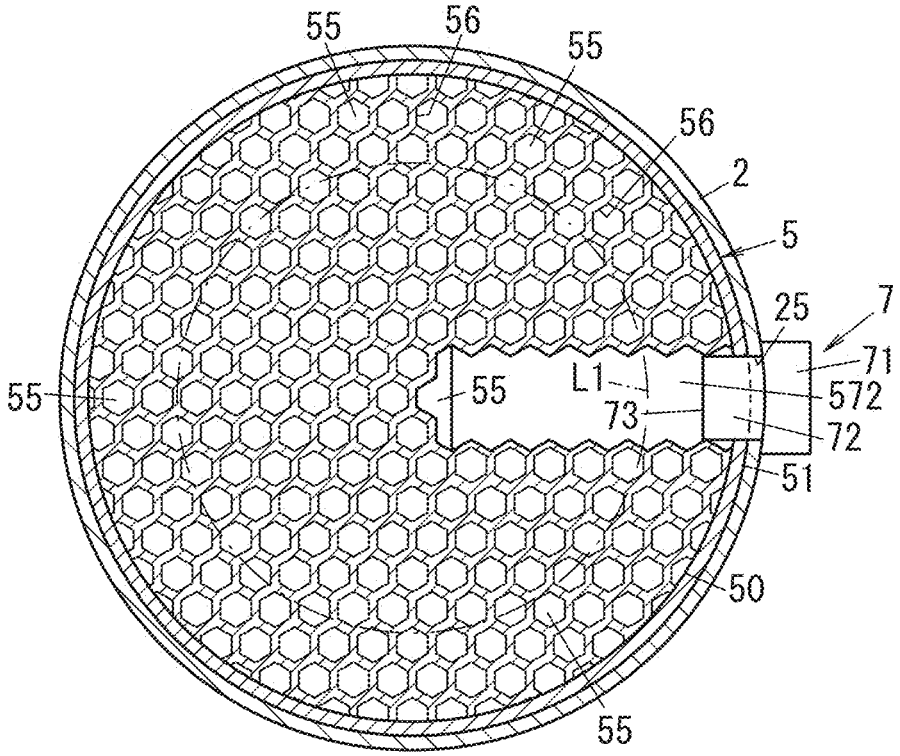
FIG. 9 is a cross-sectional view taken along the plane A-A shown in FIG. 8.

As shown in FIG. 8, the rectifier unit 8 of the air blower 1 according to the fourth embodiment includes the first rectifier 4 and the second rectifier 5.

The second rectifier 5 according to the fourth embodiment has a passage portion 57 arranged to obstruct the flow channel 26. The passage portion 57 protrudes, along the radius of the cylindrical portion 51, from an end of the cylindrical portion 51 through the vicinity of the center axis 20 of the body 2. The passage portion 57 includes a first wall 571, a second wall 572, a third wall 573, and an emitting portion 574. The passage portion 57 also has an internal space Sp1 surrounded with the first wall 571, the second wall 572, the third wall 573, the emitting portion 574, and a plurality of partitions 56.

The first wall 571 partially covers the first end 511 that is the upstream end of the cylindrical portion 51. That is to say, the first wall 571 obstructs a part of the flow channel 26. When viewed in plan in the direction D1, the first wall 571 protrudes, along the radius of the cylindrical portion 51, from an end of the cylindrical portion 51 through the vicinity of the center axis 20 of the body 2. The first wall 571 has the shape of a rectangular plate.

The second wall 572 partially covers the second end 512 that is the downstream end of the cylindrical portion 51. That is to say, the second wall 572 obstructs a part of the flow channel 26. When viewed in plan in the direction D1, the second wall 572 protrudes, along the radius of the cylindrical portion 51, from an end of the cylindrical portion 51 through the vicinity of the center axis 20 of the body 2. The second wall 572 has the shape of a rectangular plate.

The first wall 571 and the second wall 572 face each other in the direction D1. When viewed in plan in the direction D1, the first wall 571 and the second wall 572 do not overlap with the central portion 46 of the first rectifier 4. Also, as shown in FIG. 9, the respective ends, adjacent to the center axis 40, of the first wall 571 and the second wall 572 fall within the range defined by projecting, in the direction D1, the first region R1 at the outlet port 24 (i.e., at the predetermined position). Note that in FIG. 9, the one-dot chain L1 indicates the range defined by projecting, in the direction D1, the first region R1 at the outlet port 24 (i.e., at the predetermined position).

The third wall 573 shown in FIG. 8 protrudes, in the direction D1, from one end, adjacent to the center axis 40, of the first wall 571 toward one end, adjacent to the center axis 40, of the second wall 572. The third wall 573 has the shape of a plate. As shown in FIG. 8, the length of the third wall 573 as measured in the direction D1 is shorter than the length of the plurality of partitions 56 as measured in the direction D1. The third wall 573 falls within the range defined by projecting, in the direction D1, the first region R1 at the outlet port 24 (i.e., at the predetermined position).

The emitting portion 574 connects the internal space Sp1 of the passage portion 57 to the flow channel 55 (flow channel 26). The emitting portion 574 according to the fourth embodiment is a gap left between a downstream end (lower end) of the third wall 573 and the second wall 572. The emitting portion 574 falls within the range defined by projecting, in the direction D1, the first region R1 at the outlet port 24 (i.e., at the predetermined position).

The internal space Sp1 is a space located downstream of the first wall 571. More specifically, the internal space Sp1 according to the first embodiment is a space interposed, in the direction D1, between the first wall 571 and the second wall 572. In other words, the first wall 571 and the second wall 572 face each other in the direction D1 with the internal space Sp1 interposed between themselves. Note that the internal space Sp1 is a space defined by making the first wall 571 obstruct the flow channel 26 and does not form part of the flow channel 26 of the gas.

The communication hole 25 according to the fourth embodiment connects the outside of the body 2 to the internal space Sp1. When viewed in plan along the radius of the cylindrical portion 51, the communication hole 25 according to the fourth embodiment overlaps with the internal space Sp1 and the emitting portion 574.

The coupler 72 according to the fourth embodiment connects the generator 71 provided outside the body 2 to the internal space Sp1 of the passage portion 57. In other words, the coupler 72 connects the generator 71 provided outside the body 2 to the imparter 73 provided inside the internal space Sp1 of the passage portion 57.

The imparter 73 according to the fourth embodiment emits the functional component into the internal space Sp1 of the passage portion 57. The functional component emitted into the internal space Sp1 is transferred from the emitting portion 574 into the flow channel 55. That is to say, the imparter 73 emits the functional component into the internal space Sp1 of the passage portion 57 to make the emitting portion 574 impart the functional component to the airflow.

In the air blower 1 according to the fourth embodiment, the imparter 73 imparts the functional component to the airflow via the passage portion 57 of the second rectifier 5, thus eliminating the need to dispose the imparter 73 within the range defined by projecting, in the direction D1, the first region R1 at the predetermined position (i.e., at the outlet port 24). Eliminating the need to dispose the imparter 73 within the range defined by projecting, in the direction D1, the first region R1 at the predetermined position (i.e., at the outlet port 24) allows the length of the coupler 72, for example, to be reduced.

In addition, the emitting portion 574 of the (passage portion 57 of the) second rectifier 5 imparts the functional component to the gas, and therefore, may be regarded as serving as a part of the supplier 7. Thus, it can be said that the supplier 7 according to the fourth embodiment is formed integrally with the second rectifier 5.

Forming the supplier 7 integrally with the second rectifier 5 (of the rectifier unit 8) contributes to reducing not only the number of components required but also the overall size of the air blower 1 as well. In addition, forming the second rectifier 5, provided adjacent to the outlet port 24, integrally with the supplier 7 makes it easier for the functional component imparted to the gas to remain in the first airflow.

Alternatively, the third wall 573 may form part of the plurality of partitions 56. If the third wall 573 forms part of the plurality of partitions 56, then the emitting portion 574 may be formed by providing a hole through the third wall 573 (as a part of the plurality of partitions 56), for example.

Note that the various configurations described for the fourth embodiment may be adopted as appropriate in combination with the various configurations (including variations) already described for the first to third embodiments.

Fifth Embodiment

In an air blower 1 according to a fifth embodiment, the imparter 73 generates the functional component, which is a difference from the air blower 1 according to the first embodiment described above.

The air blower 1 according to the fifth embodiment will now be described with reference to FIG. 10.

Figure 10:
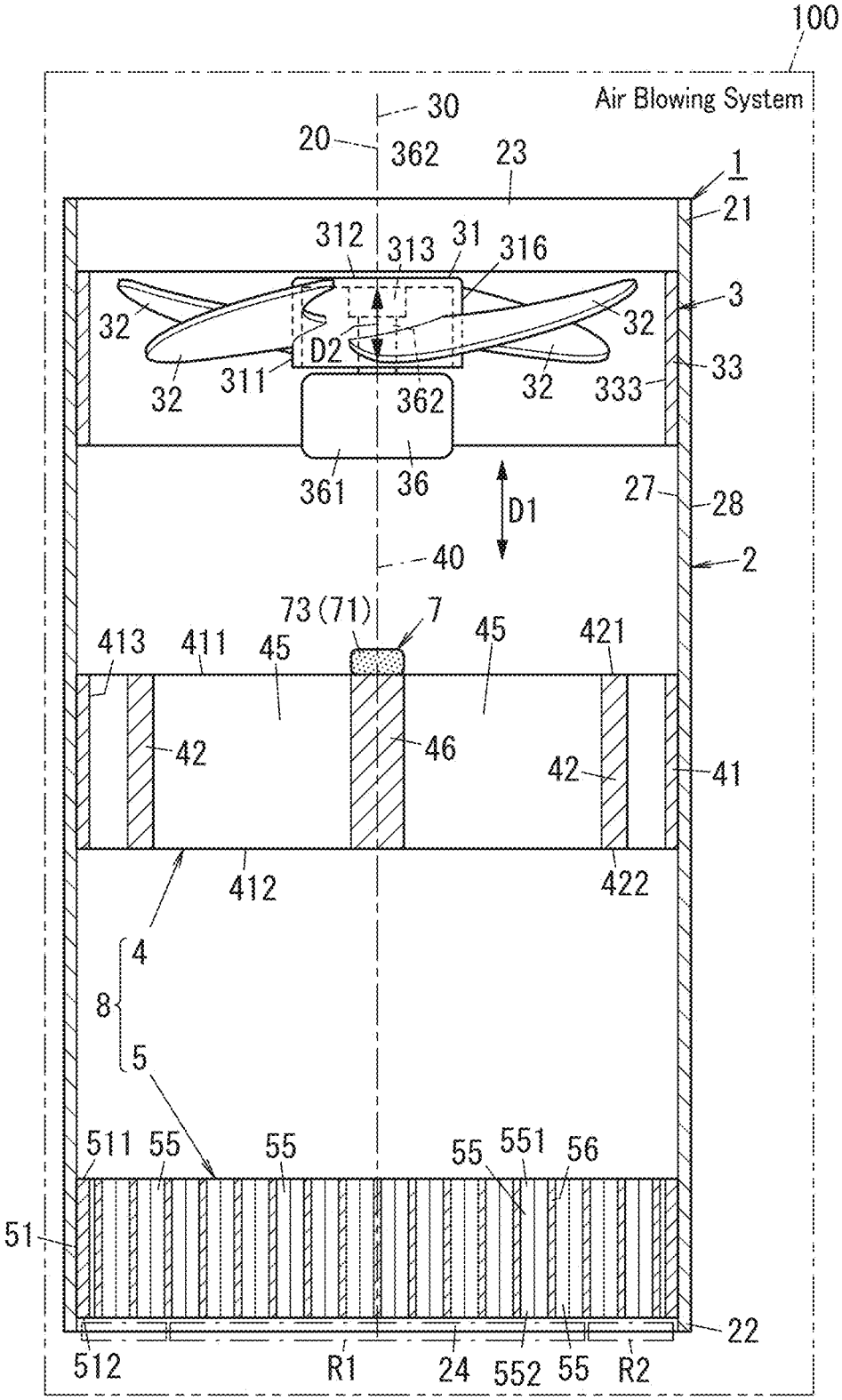
FIG. 10 illustrates a schematic configuration for an air blower according to a fifth embodiment.

As shown in FIG. 10, the supplier 7 according to the fifth embodiment has its function performed by the imparter 73. The imparter 73 according to the fifth embodiment is disposed at the upper end of the central portion 46 of the first rectifier 4. The imparter 73 falls within the range defined by projecting, in the direction D1, the first region R1 at the predetermined position (i.e., at the outlet port 24) and extending from the second inlet port 411 through the outlet port 24.

The imparter 73 according to the fifth embodiment also serves as the generator 71 for generating the functional component. The imparter 73 is made of a porous material containing a source material (functional material) that emits the functional component. As used herein, the "porous material" refers to a material having a large number of microscopic pores. The functional material according to the fifth embodiment emits the functional component into the gas by volatilizing or vaporizing.

The air blower 1 according to the fifth embodiment does not have to include the coupler 72 (refer to FIG. 1) that connects, for example, the imparter 73 to the generator 71 that generates the functional component, thus reducing the chances of the coupler 72, for example, obstructing the stream of the airflow. In addition, the supplier 7 according to the fifth embodiment is made of the porous material containing a source material that emits the functional component, and therefore, there is no need to connect a power supply or a controller, for example, to the supplier 7. This contributes to reducing the number of components required for the supplier 7 and the overall size of the supplier 7.

Note that the various configurations described for the fifth embodiment may be adopted as appropriate in combination with the various configurations (including variations) already described for the first to fourth embodiments.

Sixth Embodiment

In an air blower 1 according to a sixth embodiment, the imparter 73 having the capability of generating the functional component is formed integrally with the second rectifier 5, which is a difference from the air blower 1 according to the fifth embodiment described above.

The air blower 1 according to the sixth embodiment will now be described with reference to FIG. 11.

Figure 11:
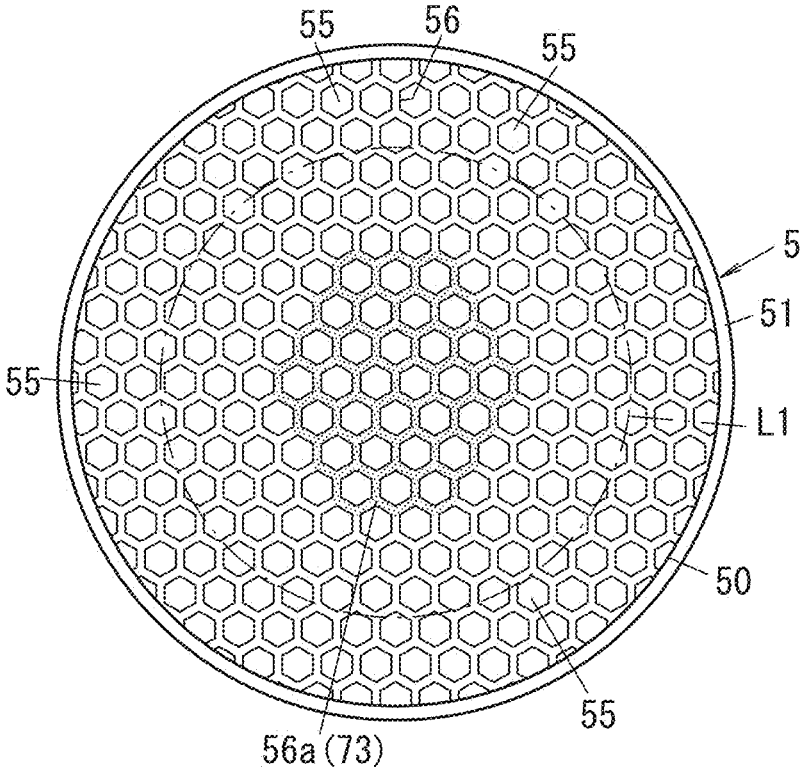
FIG. 11 is a plan view of a second rectifier included in an air blower according to a sixth embodiment.

FIG. 11 is a plan view of the second rectifier 5 as viewed in the direction D1. As shown in FIG. 11, the plurality of partitions 56 of the second rectifier 5 according to the sixth embodiment includes a plurality of partitions 56*a*. In FIG. 11, the dotted hatched part indicates the plurality of partitions 56*a* belonging to the plurality of partitions 56.

As shown in FIG. 11, the plurality of partitions 56*a* are located inside the one-dot chain circle L1. That is to say, the plurality of partitions 56*a* falls within the range defined by projecting, in the direction D1, the first region R1 at the outlet port 24 (at the predetermined position).

The plurality of partitions 56*a* is made of a porous material containing a source material (functional material) that emits the functional component. The functional material according to the fifth embodiment emits the functional component into the gas by volatilizing or vaporizing. That is to say, the plurality of partitions 56*a* serves as not only the generator 71 for generating the functional component but also the imparter 73 for imparting the functional component to the airflow.

In the air blower 1 according to the sixth embodiment, a part (i.e., the plurality of partitions 56*a*) of the second rectifier 5 located adjacent to the outlet port 24 serves as the imparter, thus making it easier for the functional component to remain in the first airflow.

Note that the various configurations described for the sixth embodiment may be adopted as appropriate in combination with the various configurations (including variations) already described for the first to fifth embodiments.

Recapitulation

As can be seen from the foregoing description, an air blower (1) according to a first aspect includes a body (2), a fan (3), a rectifier unit (8), and an imparter (73). The body (2) has a first inlet port (23) for a gas, an outlet port (24) for the gas, and a flow channel (26). The first inlet port (23) is provided at a first end (21) of the body (2). The outlet port (24) is provided at a second end (22) of the body (2). The flow channel (26) connects the first inlet port (23) to the outlet port (24). The flow channel (26) has a circular cross section. The fan (3) is disposed inside the body (2). The fan (3) generates an airflow as a stream of the gas. The rectifier unit (8) is disposed between the fan (3) and the outlet port (24) in a direction (D1) aligned with a direction pointing from the first inlet port (23) toward the outlet port (24). The rectifier unit (8) has a second inlet port (411) for the gas. The imparter (73) emits a functional component and thereby imparts the functional component to the airflow. The rectifier unit (8) divides the airflow into a first airflow and a second airflow. A first region (R1) where the first airflow passes is located inside a second region (R2) where the second airflow passes when viewed in plan in the direction (D1). The first airflow has a flow velocity equal to or greater than a predetermined value at a predetermined position (i.e., at the outlet port 24). The second airflow has a flow velocity less than the predetermined value at the predetermined position. The imparter (73) imparts the functional component to the airflow within a range defined by projecting, in the direction (D1), the first region (R1) at the predetermined position and extending from the second inlet port (411) through the outlet port (24).

According to this aspect, the functional component is imparted to the airflow within a range defined by projecting the first region (R1) in the direction (D1) and extending from the second inlet port (411) through the outlet port (24), thus allowing the functional component to be imparted to the first airflow with good stability. The first airflow does not diffuse easily, which enables carrying the functional component efficiently to a target region while reducing the diffusion of the functional component.

In an air blower (1) according to a second aspect, which may be implemented in conjunction with the first aspect, the rectifier unit (8) includes a first rectifier (4) and a second rectifier (5). The first rectifier (4) has the second inlet port (411). The first rectifier (4) changes a flowing direction of the airflow. The second rectifier (5) is interposed, in the direction (D1), between the first rectifier (4) and the outlet port (24). The second rectifier (5) unifies flowing directions of the airflow into the direction pointing from the first inlet port (23) toward the outlet port (24). The imparter (73) imparts the functional component to the airflow at the second inlet port (411).

According to this aspect, the functional component is imparted to the airflow at the second inlet port (411), thus making it easier for the functional component imparted to remain in the first airflow.

In an air blower (1) according to a third aspect, which may be implemented in conjunction with the first aspect, the rectifier unit (8) includes a first rectifier (4), a second rectifier (5), and a third rectifier (6). The first rectifier (4) has the second inlet port (411). The first rectifier (4) changes a flowing direction of the airflow. The second rectifier (5) is interposed, in the direction (D1), between the first rectifier (4) and the outlet port (24). The second rectifier (5) unifies flowing directions of the airflow into the direction pointing from the first inlet port (23) toward the outlet port (24). The third rectifier (6) is interposed, in the direction (D1), between the first rectifier (4) and the second rectifier (5). The third rectifier (6) has a flow channel (26) with a circular cross section. The third rectifier (6) has: an inlet (613) that lets the gas flow into the third rectifier (6) and has a circular shape; and an outlet (614) that lets the gas flow out of the third rectifier (6) and also has a circular shape. The outlet (614) has a smaller diameter than the inlet. The imparter (73) emits the functional component toward the inlet (613) of the third rectifier (6) and thereby imparts the functional component to the airflow at the outlet (614) of the third rectifier (6).

According to this aspect, the imparter (73) imparts the functional component to the airflow at the outlet (614) having a smaller diameter than the inlet (613), thus allowing the functional component to remain in the first airflow more efficiently.

In an air blower (1) according to a fourth aspect, which may be implemented in conjunction with the first aspect, the rectifier unit (8) includes a first rectifier (4) and a second rectifier (5). The first rectifier (4) has the second inlet port (411). The first rectifier (4) changes a flowing direction of the airflow. The second rectifier (5) is interposed in the direction (D1) between the first rectifier (4) and the outlet port (24). The second rectifier (5) unifies flowing directions of the airflow into the direction pointing from the first inlet port (23) toward the outlet port (24). The imparter (73) imparts the functional component to the airflow at a point between the second rectifier (5) and the outlet port (24).

This aspect may reduce the chances of the functional component imparted to the airflow adhering to the rectifier unit (8) and/or the body (2).

In an air blower (1) according to a fifth aspect, which may be implemented in conjunction with the first aspect, the rectifier unit (8) includes a first rectifier (4) and a second rectifier (5). The first rectifier (4) has the second inlet port (411). The first rectifier (4) changes a flowing direction of the airflow. The second rectifier (5) is interposed in the direction (D1) between the first rectifier (4) and the outlet port (24). The second rectifier (5) unifies flowing directions of the airflow into the direction pointing from the first inlet port (23) to the outlet port (24). The second rectifier (5) has a passage portion (57) arranged to obstruct the flow channel (26). The passage portion (57) has an emitting portion (574) connecting an internal space (Sp1) of the passage portion (57) to the flow channel (26; 55). The emitting portion (574) falls within the range defined by projecting, in the direction (D1), the first region (R1) at the predetermined position (i.e., at the outlet port 24). The imparter (73) emits the functional component into the internal space (Sp1) of the passage portion (57) and thereby imparts the functional component to the airflow at the emitting portion (574).

According to this aspect, the imparter (73) imparts the functional component to the airflow through the passage portion (57) of the second rectifier (5), thus eliminating the need to dispose the imparter (73) within the range defined by projecting, in the direction (D1), the first region (R1) at the predetermined position (i.e., at the outlet port 24).

An air blower (1) according to a sixth aspect, which may be implemented in conjunction with any one of the first to fifth aspects, further includes a generator (71) and a coupler (72). The generator (71) generates the functional component. The coupler (72) connects the imparter (73) to the generator (71). The generator (71) is located outside the flow channel (26).

According to this aspect, the generator (71) is located outside the flow channel (26), thus reducing the chances of the coupler (72) obstructing the stream of the airflow.

In an air blower (1) according to a seventh aspect, which may be implemented in conjunction with any one of the first to fifth aspects, the imparter (73) falls within a range defined by projecting, in the direction (D1), the first region (R1) at the predetermined position (i.e., at the outlet port 24) and extending from the second inlet port (411) to the outlet port (24). The imparter (73) generates the functional component.

This aspect allows the imparter (73) to generate the functional component by itself, thus eliminating the need to provide the coupler (72) to connect the imparter (73) to the generator for generating the functional component, for example. This reduces the chances of the coupler (72), for example, obstructing the stream of the airflow.

In an air blower (1) according to an eighth aspect, which may be implemented in conjunction with the seventh aspect, the imparter (73) is made of a porous material including a source material that emits the functional component.

This aspect eliminates the need to provide a power supply or a controller, for example, to have the functional component emitted, thus contributing to cutting down the number of components required for the imparter (73) and the reducing the overall size thereof.

Note that the constituent elements according to the second to eighth aspects are not essential constituent elements for the air blower (1) but may be omitted as appropriate.

REFERENCE SIGNS LIST

1 Air Blower
2 Body
21 First End
22 Second End
23 First Inlet Port
24 Outlet Port
26 Flow Channel
3 Fan
4 First Rectifier
411 Second Inlet Port
5 Second Rectifier
55 Flow Channel
**56*b*** Partition (Imparter)
57 Passage Portion
574 Emitting Portion
6 Third Rectifier
613 Inlet
614 Outlet

62 Flow Channel
71 Generator
72 Coupler
73 Imparter
8 Rectifier Unit
D1 Direction
R1 First Region
R2 Second Region
Sp1 Internal Space

The invention claimed is:

1. An air blower comprising:

a body having a first inlet port for a gas at a first end of the body and an outlet port for the gas at a second end of the body and also having a flow channel connecting the first inlet port to the outlet port, the flow channel having a circular cross section;

a fan disposed inside the body and configured to generate an airflow as a stream of the gas;

a rectifier having a second inlet port for the gas and disposed between the fan and the outlet port in a direction pointing from the first inlet port toward the outlet port; and an imparter configured to emit a functional component and impart the functional component to the airflow, wherein:

the rectifier is configured to divide the airflow into a first airflow and a second airflow, a first region where the first airflow passes is located inside a second region where the second airflow passes when viewed in plan in the direction, the first airflow has a flow velocity higher than a flow velocity of the second airflow at a predetermined position along the direction, the imparter is configured to impart the functional component to the airflow within a range defined by projecting, in the direction, the first region at the predetermined position and extending from the second inlet port through the outlet port, the rectifier comprises:

a first rectifier having the second inlet port and configured to change a flowing direction of the airflow; and a second rectifier interposed, in the direction, between the first rectifier and the outlet port and configured to unify flowing directions of the airflow into the direction pointing from the first inlet port toward the outlet port, and the first rectifier is configured to turn the airflow swirling downstream of the fan into the airflow directed toward a central axis of the fan, thereby forming, downstream of the first rectifier, a flow velocity distribution in which a velocity of the first airflow is higher than a velocity of the second airflow.

2. The air blower of claim 1, wherein the imparter is configured to impart the functional component to the airflow at the second inlet port.

3. The air blower of claim 1, wherein the rectifier includes:

a third rectifier interposed in the direction between the first rectifier and the second rectifier and having a flow channel with a circular cross section, the third rectifier has: an inlet configured to let the gas flow into the third rectifier and having a circular shape; and an outlet configured to let the gas flow out of the third rectifier and also having a circular shape, the outlet has a smaller diameter than the inlet, and the imparter is configured to emit the functional component toward the inlet of the third rectifier and thereby impart the functional component to the airflow at the outlet of the third rectifier.

4. The air blower of claim 1, wherein the imparter is configured to impart the functional component to the airflow at a point between the second rectifier and the outlet port.

5. The air blower of claim 1, wherein the second rectifier has a passage arranged to obstruct the flow channel, the passage has an emitter connecting an internal space of the passage to the flow channel, the emitter falls within the range defined by projecting, in the direction, the first region at the predetermined position, and the imparter is configured to emit the functional component into the internal space of the passage and thereby impart the functional component to the airflow at the emitter.

6. The air blower of claim 1, further comprising:

a generator configured to generate the functional component; and a coupler connecting the imparter to the generator, wherein the generator is located outside the flow channel.

7. The air blower of claim 1, wherein the imparter falls within a range defined by projecting, in the direction, the first region at the predetermined position and extending from the second inlet port to the outlet port, the imparter being configured to generate the functional component.

8. The air blower of claim 7, wherein the imparter is made of a porous material including a source material that emits the functional component.

* * * * *